United States Patent [19]

Sanford

[11] 4,109,728

[45] Aug. 29, 1978

[54] APPARATUS AND METHOD FOR PROTECTING WELL BORE

[76] Inventor: Lawrence Sanford, 4047 Hollister, Houston, Tex. 77055

[21] Appl. No.: 778,956

[22] Filed: Mar. 18, 1977

[51] Int. Cl.[2] ..... E21B 23/00; E21B 23/04

[52] U.S. Cl. ..... 166/315; 166/85; 166/217

[58] Field of Search ..... 166/315, 207, 0.5, 243, 166/217, 75, 85; 175/7

[56] References Cited

U.S. PATENT DOCUMENTS

| | | | |
|---|---|---|---|
| 3,225,833 | 12/1965 | Parkhurst et al. | 166/207 |
| 3,240,511 | 3/1966 | Bishop et al. | 166/315 |
| 3,254,723 | 6/1966 | Schramm | 166/217 |
| 3,350,130 | 10/1967 | Ahlstone et al. | 166/0.5 |
| 3,473,607 | 10/1969 | Castille | 166/75 |
| 3,473,608 | 10/1969 | Castille | 166/85 |
| 3,645,328 | 2/1972 | Greene, Jr. | 166/85 |
| 4,023,620 | 5/1977 | Gazda et al. | 166/217 |

*Primary Examiner*—James A. Leppink

*Attorney, Agent, or Firm*—Browning, Bushman & Zamecki

[57] ABSTRACT

A tool for running in and/or retrieving a bore protector, the tool comprising first and second assemblies longitudinally slidably connected to each other. Latches are mounted on the first assembly for lateral extension and retraction with respect thereto. The latches are also cooperatively connected to the second assembly for laterally inward movement of the latches upon longitudinal movement of the second assembly relative to the first assembly in a first direction, and for laterally outward movement of the latches upon longitudinal movement of the second assembly relative to the first assembly in a second direction opposite the first direction. Means are provided for selectively moving the second assembly in the first direction, and the latches are yieldably biased laterally outwardly. The invention further includes a bore protector adapted for use with the tool by the provision of the internal latch engagement formations. A method of protecting a bore with the bore protector and tool is also disclosed.

29 Claims, 5 Drawing Figures

FIG. 3
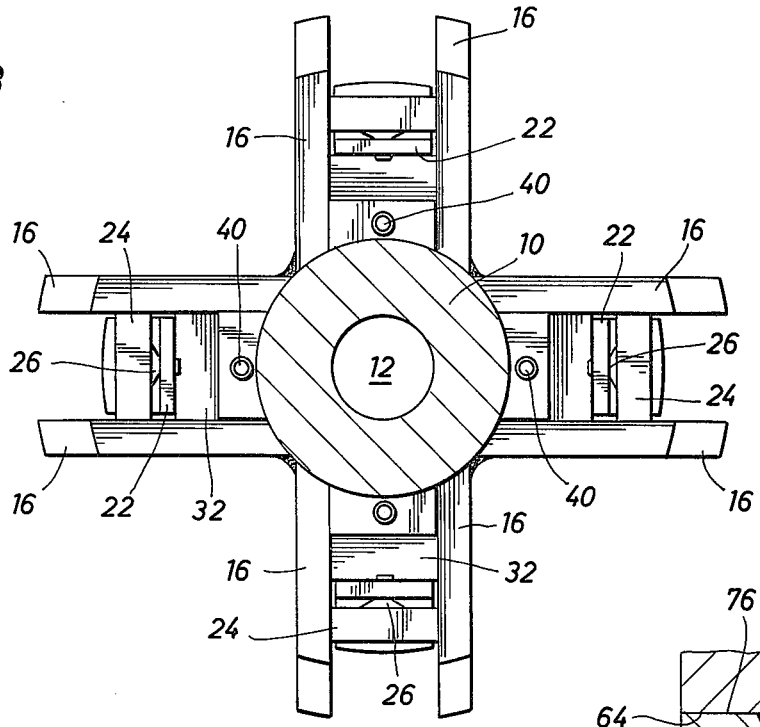
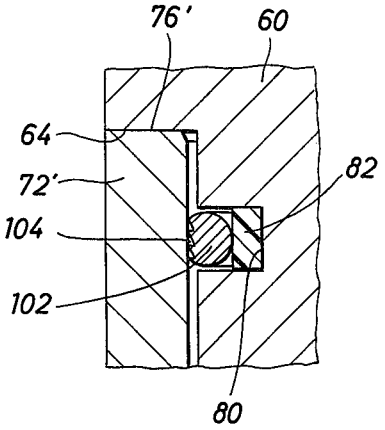
FIG. 5
FIG. 4
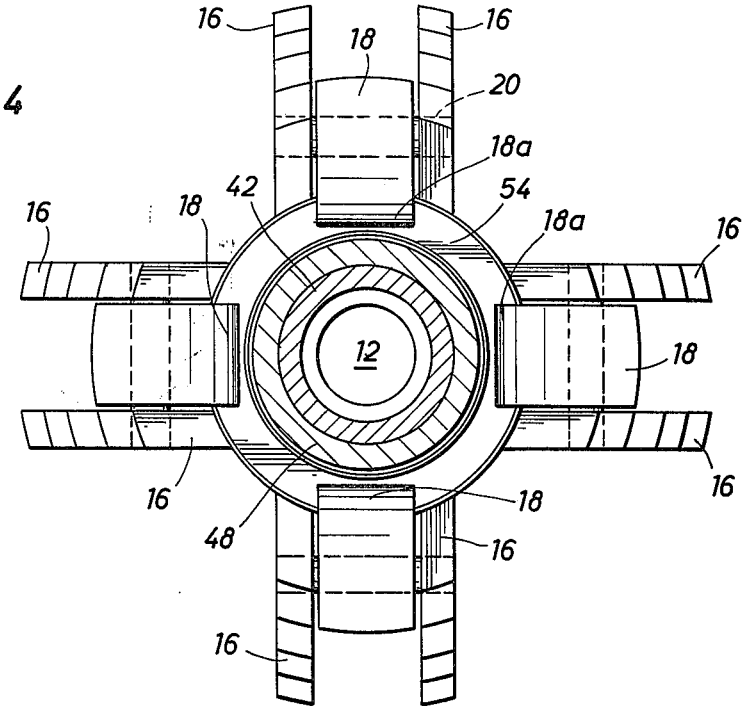

APPARATUS AND METHOD FOR PROTECTING WELL BORE

BACKGROUND OF THE INVENTION

1. Field of the Invention

The present invention pertains to bore protectors and their use. In connection with subsea wells, a well head assembly is provided from which one or more casing strings are usually suspended. Additionally, a blow-out preventer is normally provided on the well head assembly above the casings. This blow-out preventer must be periodically tested to assure that it is working properly and, in particular, is usually tested at least before setting the first string of casing and after setting that string and each successive string. However, it is often necessary or at least advisable to test even more frequently.

In order to perform these tests, the bore of the well head must be sealed off, and adequate sealing requires a relatively smooth seal area on the well head bore against which a plug or the like can seal. However, such seal area can be marred or scored by apparatus extending into the well head during drilling and other operations due to the movements of such apparatus and/or the supporting platform caused by currents, wave action, etc. Accordingly, it is customary to employ a tubular or sleeve-like bore protector to cover and protect the seal area during such operations.

2. Description of the Prior Art

In the past, the tools used for running in and retrieving such bore protectors have been relatively complicated mechanically. This not only made the tools themselves expensive, but also made the running and retrieving process complicated and time consuming.

This problem has been further aggravated by the fact that it is impossible to seal the annulus between the well bore and the bore protector. Thus in most conventional systems, the bore protector has to be retrieved and re-set each time the blow-out preventer is tested.

Still another problem has resulted from the presence of "gumbo" in certain well formations which literally pumps the bore protector upwardly dislodging it from its seat in the well head.

SUMMARY OF THE INVENTION

The present invention provides an improved running and retrieving tool for bore protectors comprising first and second assemblies longitudinally slidably connected to each other. Latch means are mounted on the first assembly for lateral extension and retraction with respect to the first assembly. The latch means are further cooperatively connected to the second assembly for laterally inward movement of the latch means upon longitudinal movement of the second assembly relatively to the first assembly in a first direction, and for laterally outward movement of the latch means upon longitudinal movement of the second assembly relative to the first assembly in a second direction opposite the first direction. Means are operatively associated with the second assembly for selectively moving the second assembly in the first direction. Other means are operatively associated with the latch means yieldably biasing the latch means laterally outwardly.

An improved bore protector is also provided having internal formations adapted for engagement with the latch means of the tool. The tool may thus be inserted into the bore protector, the biasing means yielding to allow sufficient retraction of the latch means to permit such insertion. When the latch means are aligned with the latch engaging formations of the bore protector, they automatically snap into engagement. The bore protector is thus suspended from the tool and may be lowered into the well head assembly until it engages a landing provided therein. The second assembly is then moved in the first direction to retract the latch means, and the tool is withdrawn from the bore protector and well head.

To retrieve the bore protector, the same tool is lowered into the well head and re-inserted in the bore protector. The latch means may be allowed to snap into place as before. However, if the extended latches pose any danger to the blow-out preventer, the seal area on the well head bore, or any other part of the well apparatus, the latches may be easily retracted during part or all of the re-insertion process. The latches are then permitted to re-engage the latch engaging formations of the bore protector and the latter is then pulled from the well head.

The improved tool of the present invention not only simplifies the running-in and retrieving processes, but is itself relatively simplified resulting in reduction in manufacturing costs. This simplification is in part made possible by the adaptation of the bore protector to provide the latch engaging formations.

While the tool and bore protector are adaptable for use in any type of system, they are particularly suited for use in systems in which the blow-out preventer may be tested without retrieving the bore protector. Accordingly, the bore protector may be sized so that, when seated on the landing in the well head assembly, its upper edge is disposed below the upper edge of the bore section to be protected to provide an annular seal area above the bore protector. The bore protector still covers a sufficient portion of the bore section to prevent harmful contact of the seal area by the drilling apparatus by holding the drilling apparatus away from the seal area.

The bore protector may be further improved by the provision thereof of lock means engageable with the well head assembly to prevent upward dislodgement of the bore protector.

Accordingly, it is a principal object of the present invention to provide an improved tool for running in and/or retrieving a tubular body such as a bore protector.

A more specific object of the present invention is to provide such a tool having a unique latch mechanism.

Another object of the invention is to provide an improved bore protector having lock means for engagement with a well head assembly.

Still another object of the present invention is to provide an improved method of protecting a bore section of a well head assembly.

Additional objects, features, and advantages of the present invention will be made apparent by the following description of the preferred embodiments, the drawings, and the claims.

BRIEF DESCRIPTION OF THE DRAWINGS

FIG. 3 is a cross-sectional view taken along lines 3—3 of FIG. 2.

FIG. 4 is a transverse cross-sectional view taken along lines 4—4 of FIG. 2.

FIG. 5 is an enlarged detailed sectional view of a modification of the lock means of the tool of FIGS. 1–4.

DESCRIPTION OF THE PREFERRED EMBODIMENTS

Figure 1:
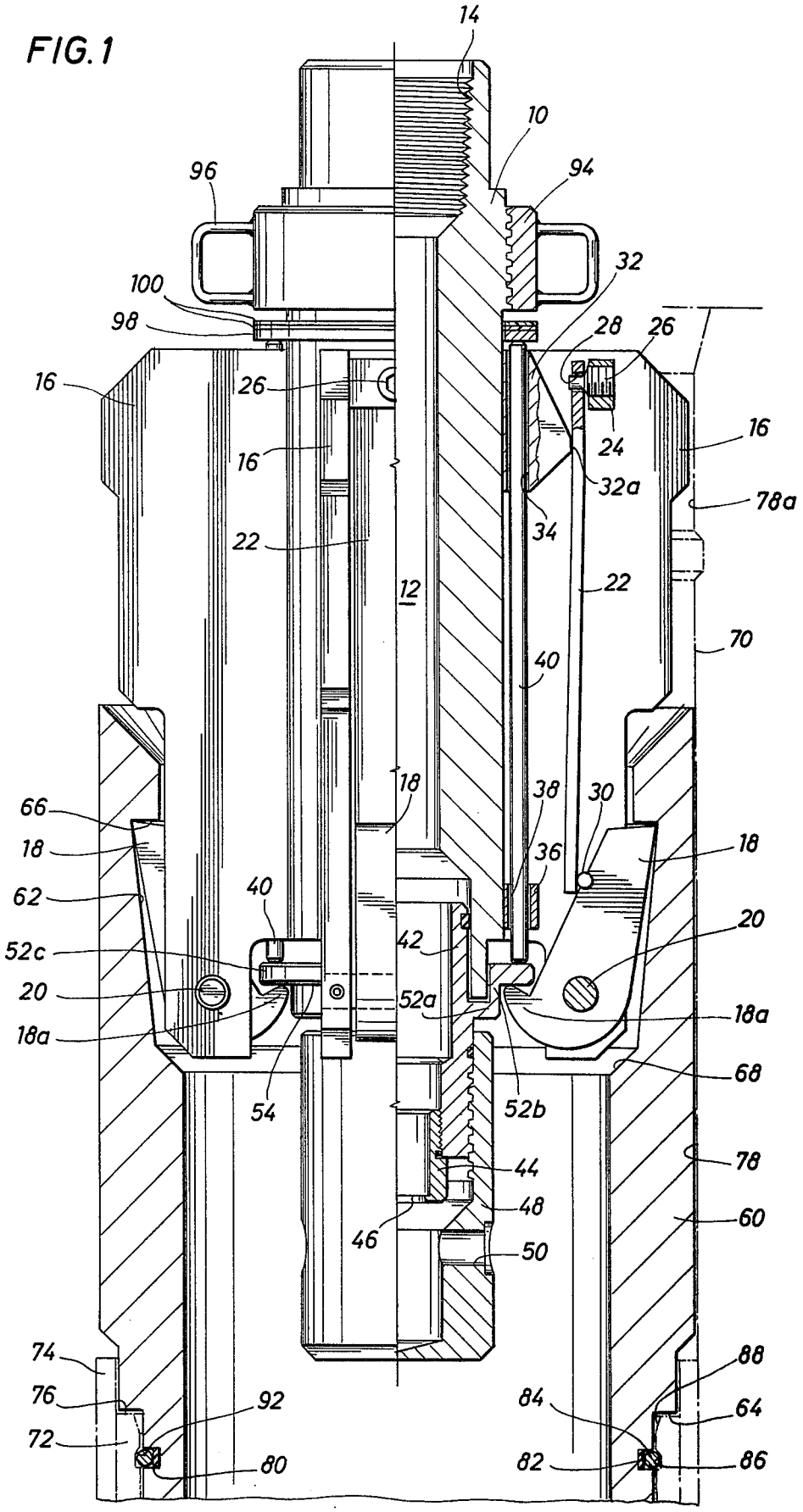
FIG. 1 is a quarter-sectional view of a run and retrieve tool according to the present invention, a bore protector according to the invention being shown in cross section engaged by the tool and the well head assembly being shown in phantom.

Referring now to the drawings, the run and retrieve tool comprises a first assembly including a central tubular member 10 defining the central throughway 12 of the first assembly. The upper end of member 10 forms a threaded box 14, whereby the tool may be supported by a string of drill pipe or the like. The first assembly further comprises frame means including a plurality of metal plates 16 welded to the exterior of member 10 and extending longitudinally therealong and laterally outwardly therefrom. As best seen in FIGS. 3 and 4, the plates are arranged in four pairs, the plates of each pair being parallel and the four pairs being symmetrically disposed about the member 10. A latch member 18 is pivotally mounted between each pair of plates 16 near the lower ends thereof on a pin 20 extending between the plates whereby the latch is laterally extendable and retractable with respect to the first assembly.

Each of the latches 18 is yieldably biased laterally outwardly by a respective leaf spring 22. An internally threaded sleeve 24 is welded between each pair of plates 16, near the upper ends thereof, with its bore extending generally radially with respect to the central member 10. A screw 26 is threaded into each of the sleeves 24. Each screw 26 has a reduced diameter end portion extending inwardly therefrom and received in a bore 28 through the respective one of the springs 22. Thus each spring is removably suspended on the tool. The lower end of each spring 22 is disposed laterally inwardly of a respective one of the latches 18. Each latch 18 has a bead 30 formed on its inner side upwardly of the pivot pin 20 to provide a bearing surface for the respective spring 18. A respective fulcrum plate 32 is welded to the exterior of the central member 10 between each pair of plates 16 near the upper ends thereof. Each plate 32 has upper and lower surfaces inclined radially outwardly and longitudinally toward each to form a fulcrum surface 32*a* engaging the respective spring 22 slightly below its upper end.

Each of the plates 32 has a longitudinal bore 34 therethrough. A guide sleeve 36 is welded to the exterior of central member 10 below each of the plates 32 with the bore 38 of each sleeve 36 in alignment with the bore 34 of the respective plate 32. Each of the bores 34 slidably receives the upper end of a force transmitting rod 40, the lower end of which is received in the respective bore 38. The function of the rods 40 will be described more fully hereafter.

The lower end of the throughway 12 of the central member 10 of the first assembly of the tool is enlarged to form a cylinder for receipt of a tubular piston member 42, which comprises a part of the second assembly of the tool. The upper end of piston member 42 is slidably received in the cylinder formed by throughway 12, and the lower end extends downwardly therefrom. The lower end of the piston member 42 has internal threads which receive a generally tubular seat member 44 having a lower internal annular flange 46 extending radially inwardly to form a ball seat. The lower end of piston member 42 is also externally threaded to be received within the upper end of a cage member 48. Cage 48 extends below and surrounds the ball seat and has a cup-like bottom and laterally opening jetting outlets 50 to be described more fully below.

An external annular flange is integrally formed on the piston member 42 outwardly of the central member 10 of the first assembly of the tool. This flange includes an inner portion 52*a* extending radially outwardly from the tubular portion of piston member 42 across the bottom of central member 10. The flange further includes a central portion 52*b* extending upwardly from the outer edge of portion 52*a* along the exterior of member 10, the lower portion of which is of reduced outer diameter. Finally, the flange includes an outer portion 52*c* extending radially outwardly from the upper edge of central portion 52*b*. The lower surface 54 of portion 52*c* serves as a hanger face for the second assembly of the tool.

Each of the latches 18 has a projection 18*a* extending laterally inwardly therefrom and opposing the hanger surface 54. Thus the second assembly is suspended from the first assembly via the latches 18. It can be seen that the latches 18 are cooperatively connected with the second assembly of the tool by engagement of projections 18*a* with flange portion 52*c*. Thus, upward and downward movement of the second assembly will be respectively accompanied by outward and inward movements of the latches, and vice versa.

FIG. 1 shows the tool in its normal or latching position. The latches 18 are laterally extended by the springs 22 and the second assembly 42, 44, 48 is urged upwardly by the projections 18*a* of the latches 18. Upward movement of the second assembly with respect to the first assembly, is limited by engagement of the upper surface of the flange portion 52*a* with the lower surface of central member 10, these surfaces serving as stop surfaces. The laterally inner surfaces of latches 18 and the laterally outer surfaces of guide sleeves 36 form respective pairs of second stop surfaces to limit inward movement of the latches. While in the embodiment shown, the lower ends of the springs 22 are disposed between these pairs of stop surfaces, it is also possible to provide for direct contact therebetween.

FIG. 1 also shows the bore protector which is adapted to be run into and retrieved from the well head assembly by the tool described above. The bore protector comprises a tubular body having an internal annular recess 62 and an external annular downwardly facing seating shoulder 64. The upper edge of the body 60 is bevelled to faciliate insertion of the tool into the tubular body. With the exception of the recess 62, the inner diameter of the body 60 is smaller than the outer diameter of the latches 18 in their extended positions. Thus as the tool is inserted into the body 60, the springs 22 will yield allowing the latches 18 to be deflected laterally inwardly and pass along the inner wall of the body 60. When the latches 18 reach the recess 62, they will snap outwardly into the recess. The body 60 will thus be suspended on the tool by virtue of the engagement of the upper ends of the latches 18 with the downwardly facing shoulder 66 defined by the upper portion of recess 62. The inner diameter of the body 60 is reduced adjacent the lower end of recess 62 to form, with the lower portion of the recess, an upwardly facing shoulder 68. If, for reasons to be given below, the tool should be inserted in the body 60 with the latches 18 in their retracted positions, the shoulder 68 may engage the lower ends of plates 16 to limit insertion at a point at which the latches are generally aligned with the recess 60.

After the body 60 has been mounted on the tool, the two are run into the well head assembly on a conventional operating string. As shown in phantom in FIG. 1, the well head assembly includes a well head body 70 and casing means, including a casing hanger 72 and surrounding seal assembly 74, suspended in the well head body 70 in a manner well known in the art. The casing means 72, 74 are disposed below the upper end of the well head body 70 whereby a bore section 78, defined by the well head body, is exposed. The upper end 76 of the casing hanger 72 forms an internal annular landing for the well head assembly on which the shoulder 64 may land as shown.

Body 60 has an external annular groove 80 therein. The bottom of the groove 80 is filled by an annular body 82 of polyurethane or other elastomeric material such as rubber. Body 82 may be split or continuous. Outwardly of the body 82, a split metal ring 84 is disposed partially in the groove 80. Ring 84 may be formed of spring metal having sufficient elasticity to permit it to be slipped over body 60 into groove 80 without exceeding its elastic limit. The casing hanger 72 has an internal annular depression 86 spaced from the landing 76 so that it will be aligned with the ring 84 when the shoulder 64 is seated on the landing 76. With the exception of the depression 86, the inner diameter of the casing hanger is slightly smaller than the outer diameter of ring 84 in its relaxed state. As the body 60 is emplaced in the well head assembly, the resilient body 82 permits the split ring 84, which is formed of incompressible material as noted, to be temporarily forced into the groove 80 by the inner surface of the casing hanger 72 but will subsequently urge the ring 84 back out and into the depression 86. The upper portion of the inner wall of the casing hanger 72 may be bevelled as indicated at 88 to faciliate this process. The body 60 will thus be releasably locked against upward movement in the well head assembly. The elastomeric body 82 substantially fills the bottom of groove 80 so that mud, etc. entering the groove will not interfere with its elastic action as could be the case with a spring.

With the bore protector thus properly emplaced, the body 60 is disposed within the bore section 78 and lines a substantial portion thereof. However, the body 60 is disposed below the upper end of the bore section 78 so that an upper portion 78*a* thereof is exposed as a seal area.

Figure 2:
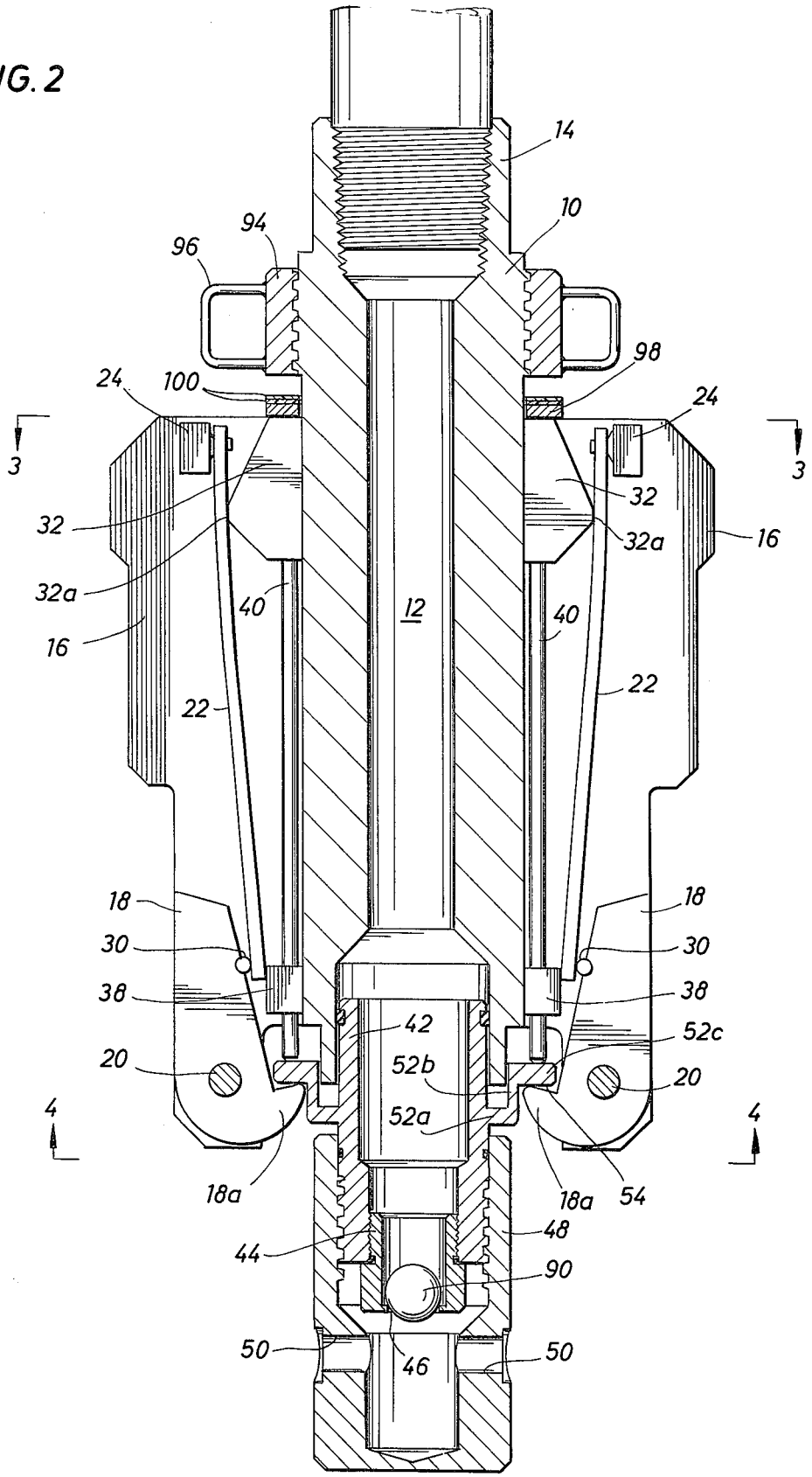
FIG. 2 is a partial sectional view of the tool of FIG. 1 with the latches in retracted position.

To release the tool, a ball plug member 90 is pumped through the drill string and the throughway 12 to land on the seat 46 in the piston member 42. Continued pumping through the drill string will then cause the piston member 42 to move downwardly and the latches to be retracted as shwon in FIG. 2. The tool can then be removed from the bore protector and well head. After such removal, further fluid pressure may, if desired, be applied through the drill string to force the ball 90, which is formed of deformable material, through the seat 46 and into the cage 48.

The body 60 of the bore protector remains in the well head assembly protecting the bore section 78. The body 60 may also extend downwardly within the casing hanger 72 to protect a seal area thereon. However, since the seal area 78*a* of the bore section 78 remains exposed, a suitable plug may be inserted into the well head at any time to seal against the area 78*a* and permit testing of the blow-out preventer (not shown) without removal of the body 60.

When it is desired to remove the body 60, as to emplace the next smaller casing hanger, such removal may be accomplished with the same tool which was used to run in the body 60. The tool is simply lowered into the well head by a drill string and re-inserted into the body 60. The latches 18 will snap into place in the recess 62 as before. An upward pull is then exerted on the drill string sufficient to temporarily force the ring 84 into the groove 80. The upper surface of depression 86 may be bevelled as at 92 to reduce the necessary force. Body 60 is thus pulled from the well head assembly.

If the recess 62 has become clogged with "gumbo," mud, cuttings, etc., the tool may be partially inserted into the body 60 and the recess 62 flushed with fluid pumped through the drill string, throughway 12 and second tool assembly 42, 44, 48 and out through the jetting outlets 50 prior to latching of the tool in the body 60.

If the blow-out preventer, seal area 78*a*, or other portions of the apparatus associated with the well head body 70 are subject to damage by the latches 18, the latter may be held in their retracted position during part or all of the insertion process by emplacing the ball 90 and exerting fluid pressure. Then when the latches 18 are aligned with the recess 62, the ball may be forced into the cage 48 to permit extension of the latches.

It should also be understood that, while it is preferable to employ the ball 90 to reduce the pressure necessary to move the piston member 42 downwardly, the relatively small bore through seat 46 provides a sufficient choking action that, upon application of a somewhat greater fluid pressure through the drill string, the latches 18 may be retracted without the ball 90.

To remove the tool from the bore protector after it has been pulled from the well, auxiliary mechanical means may be employed to retract the latches 18. These include a force imparting member in the form of a nut 94 threadedly connected to the upper portion of central member 10 and having handles 96. A bearing nut 98 surrounds the member 10 below the nut 94 and rests on the tops of the rods 40. As the nut 94 is threaded downwardly along member 10, it will engage nut 98 and impart the downward force to the second tool assembly via the rods 22 and the flange portion 52*c* of the second assembly on which the rods rest. A pair of washers 100 of teflon, polyurethane or other suitable material may be interposed between the nuts 94 and 96 to reduce friction.

Another advantageous feature of the tool of the present invention is that it may be adjusted to handle bore protectors of various sizes, by adjustment of the maximum extension of the latches 18. Fine adjustments of this nature may be made by means of the screws 26. Gross adjustments may be made by removal and replacement of the springs 22 and/or the latches themselves.

FIG. 5 shows a modification of the lock means of the bore protector which eliminates the need to provide an internal depression in the casing hanger 72'. The modification consists in the provision on the outer diameter of the lock ring 102 of a plurality of teeth 104 which may bite into the casing hanger 72' when the ring 102 is urged outwardly by the elastomeric body 82.

It will be readily apparent that the apparatus disclosed above provides numerous advantages over the prior art. In particular, it provides an improved run and retrieve tool for a bore protector or other similar tubular body and an improved method of using same. The invention also provides an improved system which permits sealing of the bore section of the well head body without removal of the bore protector. Furthermore, the invention provides an improved bore protector.

It will also be appreciated that many modifications of the preferred embodiments described above may be made without departing from the spirit of the invention. For example, the recess 62 of the bore protector may be replaced by other suitable latch engaging formations such as an internal annular upset forming a downwardly facing shoulder. The run and retrieve tool could be modified in numerous ways such as in the manner of mounting the latches. It is thus intended that the scope of the invention be limited only by the claims.

I claim:

1. Apparatus for protecting a bore section formed by a well head assembly defining a generally upwardly facing landing therein, said protecting apparatus comprising:

a tubular bore protector body having external shoulder means for seating on said landing and being configured to be disposed at least partially within and lining said bore section when said shoulder means is seated on said landing, said tubular body having an external annular groove therein, and said protecting apparatus further comprising a generally annular elastomeric body disposed in said groove and lock means comprised of substantially incompressible material disposed at least partially in said groove radially outwardly of said elastomeric body and having engagement surfaces lockingly engageable with the interior of said well head assembly, said engagement surfaces being configured to permit translation of upward forces on said tubular body to radially inward forces on said lock means, and said elastomeric body being operative to resist radially inward movement of said lock means in the presence of upward forces on said tubular body below a given magnitude but yieldable to permit radially inward movement of said lock means responsive to upward forces on said tubular body greater than or equal to said given magnitude.

2. The apparatus of claim 1 wherein said bore section has an upper edge, said tubular body being sized to be downwardly spaced from said upper edge when said shoulder means is seated on said landing to present an annular seal area on said bore section above said tubular body.

3. The apparatus of claim 1 wherein said elastomeric body substantially fills the bottom of said groove.

4. The apparatus of claim 1 wherein said tubular body has an internal latch engaging formations thereon.

5. The apparatus of claim 4 wherein said tubular body has internal recess means extending radially thereinto defining said latch engaging formations.

6. The apparatus of claim 5 wherein said latch engaging formations comprise a longitudinally downwardly facing abutment surface within said recess means.

7. The apparatus of claim 5 wherein said recess means is annular and coaxial with said tubular body.

8. The apparatus of claim 1 wherein said well head assembly includes a well head body defining said bore section and casing means suspended in said well head body below said bore section, and wherein said lock means is disposed to engage said casing means when said shoulder means is seated on said landing.

9. The apparatus of claim 8 wherein said lock means has gripping teeth on its radially outer surface for engagement with said casing means.

10. The apparatus of claim 8 wherein said casing means has an internal radial depression therein for receipt of said lock means.

11. The apparatus of claim 8 wherein said lock means comprises a split metal ring.

12. The apparatus of claim 8 wherein said elastomeric body is comprised of polyurethane.

13. The apparatus of claim 8 wherein said landing is defined by said casing means.

14. A tool for running or retrieving a tubular body in a well comprising:

first and second assemblies slidably telescopically connected to each other, said second assembly comprising a tubular piston member, and said first assembly defining a cylinder receiving said piston member whereby pressure may be applied to said piston member to selectively move said second assembly in a first longitudinal direction relative to said first assembly;

latch means mounted on said first assembly for lateral extension and retraction with respect to said first assembly and cooperatively connected to said second assembly for laterally inward movement of said latch means upon longitudinal movement of said second assembly relative to said first assembly in said first direction, and for laterally outward movement of said latch means upon longitudinal movement of said second assembly relative to said first assembly in a second direction opposite said first direction;

and means operatively associated with said latch means yieldably biasing said latch means laterally outwardly.

15. The tool of claim 14 wherein said cylinder is defined by a central throughway in said first assembly.

16. The tool of claim 14 having a passageway therethrough, said passageway having laterally opening jetting outlets.

17. The tool of claim 14 further comprising auxiliary means cooperative between said assemblies for mechanically moving said second assembly in said first direction.

18. The tool of claim 17 wherein said auxiliary means includes a force imparting member threadedly connected to said first assembly, and force transmission means interconnecting said force imparting member and said second assembly.

19. The tool of claim 14 wherein said latch means comprises a plurality of latch members each pivotally mounted on said first assembly for said lateral extension and retraction.

20. The tool of claim 19 wherein said means biasing said latch means comprises a plurality of springs each engaging a respective one of said latch members, said tool further comprising means for adjusting the force of said springs.

21. The tool of claim 19 wherein said first assembly includes a central tubular method and frame means rigidly connected to the exterior of said tubular member, said second assembly being partially telescopically disposed within said tubular member and having a flange extending laterally outwardly therefrom and having a hanger face facing generally in said first direction, and said latch members being pivotally mounted on said frame means and each having a projection extending laterally inwardly and generally opposing said hanger face.

22. The tool of claim 21 wherein said assemblies have respective opposed generally axially facing stop surfaces for limiting movement of said second assembly in said second direction.

23. The tool of claim 22 wherein said latch members and said first assembly have respective opposed generally radially facing stop surfaces for limiting retraction of said latch members.

24. A method of protecting a bore section in a well head assembly comprising the steps of:

inserting a running in tool into a tubular body, said body having internal latch engaging formations;

engaging laterally extendable latch means on said tool with said latch engaging formations to suspend said tubular body from said tool;

lowering said tool and said tubular body into said well head assembly;

seating said tubular body in said well head assembly;

landing a plug member on a plug seat in a tubular piston member in said tool;

laterally retracting said latch means from said latch engaging formations by exerting fluid pressure on said piston member;

raising said tool out of said tubular body.

25. The method of claim 24 wherein said tubular body is seated in said well head assembly below the upper edge of said bore section to provide an annular seal area on said bore section above said tubular body.

26. The method of claim 24 further comprising releaseably locking said tubular body against upward movement in said well head assembly.

27. The method of claim 24 further comprising retrieving said tubular body from said well head assembly with said tool by:

lowering said tool to said well head assembly;

re-inserting said tool into said tubular body;

re-engaging said latch means with said latch engaging formations;

raising said tool and said tubular body out of said well head assembly.

28. The method of claim 27 including retracting said latch means prior to re-insertion of said tool.

29. The method of claim 28 wherein said latch means are retracted prior to insertion of said tool by exerting fluid pressure on said piston member.

* * * * *

UNITED STATES PATENT AND TRADEMARK OFFICE

CERTIFICATE OF CORRECTION

PATENT NO. : 4,109,728

DATED : August 29, 1978

INVENTOR(S) : Lawrence Sanford

It is certified that error appears in the above-identified patent and that said Letters Patent are hereby corrected as shown below:

In Column 2, line 41, after the word provision, delete the word thereof, and insert therefor --thereon--.

In Column 5, line 56, after the word as, delete shwon, and insert therefor --shown--.

In Column 7, line 56, after the word has, delete the word "an".

In Column 7, line 59, after the word thereinto, insert therefor --and--.

In Column 8, line 63, after the word tubular, delete the word method and insert therefor --member--.

Signed and Sealed this

*Twenty-eighth* Day of *October 1980*

[SEAL]

*Attest:*

SIDNEY A. DIAMOND

*Attesting Officer*

*Commissioner of Patents and Trademarks*